US008350169B2

(12) United States Patent
Corti

(10) Patent No.: US 8,350,169 B2
(45) Date of Patent: Jan. 8, 2013

(54) THREE-POSITIONS DISCONNECTOR FOR MEDIUM VOLTAGE PANELS

(75) Inventor: Davide Corti, Nembro (IT)

(73) Assignee: ABB Technology AG, Zurich (CH)

( * ) Notice: Subject to any disclaimer, the term of this patent is extended or adjusted under 35 U.S.C. 154(b) by 270 days.

(21) Appl. No.: 12/809,248

(22) PCT Filed: Dec. 5, 2008

(86) PCT No.: PCT/EP2008/066944

§ 371 (c)(1),
(2), (4) Date: Jun. 26, 2010

(87) PCT Pub. No.: WO2009/080472

PCT Pub. Date: Jul. 2, 2009

(65) Prior Publication Data

US 2011/0000771 A1 Jan. 6, 2011

(30) Foreign Application Priority Data

Dec. 19, 2007 (EP) ..... 07150130

(51) Int. Cl.
*H01H 1/00* (2006.01)

(52) U.S. Cl. ..... 200/284

(58) Field of Classification Search ..... 200/284, 200/238, 16 R–16 D

See application file for complete search history.

(56) References Cited

U.S. PATENT DOCUMENTS 6,204,458 B1 * 3/2001 Chen et al. ..... 200/284
6,940,711 B2 * 9/2005 Heuell et al. ..... 361/668

FOREIGN PATENT DOCUMENTS

EP 1179830 A 2/2002
WO WO-03096504 A 11/2003
WO WO-2004040728 A 5/2004

* cited by examiner

*Primary Examiner* — Edwin A. Leon
(74) *Attorney, Agent, or Firm* — Connolly Bove Lodge & Hutz LLP

(57) ABSTRACT

A three-positions disconnector comprising, for each phase an insulating casing which comprises a first and a second cavity separated by an insulated partition wall, a through hole being present in said partition wall between said first and second cavity. The first cavity houses: a first fixed contact electrically connected to a corresponding branch conductor (of a bus-bar system; at least a portion of a movable contact pivotally mounted on a support positioned in the first cavity and electrically connected to a first electrical terminal positioned in said second cavity. The disconnector further comprises, for each phase, a second fixed contact suitable for ground connection. Also, the disconnector comprises an operating mechanism and a kinematical chain linking the movable contact with the operating mechanism; the movable contact is movable between a first position in which it is coupled to the first fixed contact, a second position in which it is isolated from both the first and second fixed contacts, and a third position in which it coupled to the second fixed contact.

16 Claims, 5 Drawing Sheets

THREE-POSITIONS DISCONNECTOR FOR MEDIUM VOLTAGE PANELS

CROSS REFERENCE TO RELATED APPLICATIONS

This application is a National Phase filing under 35 U.S.C.§371 of PCT/EP2008/066944 filed on Dec. 5, 2008; and this application claims priority to Application No. 07150130.8 filed in Europe on Dec. 19, 2007 under 35 U.S.C. §119; the entire contents of all are hereby incorporated by reference.

BACKGROUND OF THE INVENTION

The present invention relates to a three-positions disconnector for medium voltage applications. The disconnector of the invention finds a convenient application in medium voltage panels, particularly in medium voltage panel in which the circuit breaker is in the so-called fixed configuration. Medium voltage panels including a three-positions disconnector of the kind disclosed herein are also part of the present invention. For the purposes of the present application the term Medium Voltage is referred to applications in the range of between 1 and 52 kV.

DESCRIPTION OF PRIOR ART

Medium voltage panels are well known in the art. They usually consist of a casing that is internally divided into a circuit breaker compartment, a bus-bar compartment, a feeder/cable compartment, and a control cabinet. A metal segregation between the compartments is usually foreseen.

A circuit breaker is normally positioned inside the circuit breaker compartment and, depending on the application, it can have either a fixed configuration or a withdrawable configuration. In the former, the circuit breaker has a fixed operating position once installed; in the latter the circuit breaker is movable between a service position, in which it is connected to the bus-bar and cable systems, and a test/disconnected position in which it is isolated from the bus-bar and cable systems. To this end, the circuit breaker is provided, for each phase, with a couple of contacts that can be engaged/disengaged from corresponding stationary contacts positioned in the bus-bar and feeder/cable compartments and facing the circuit breaker compartment.

For Primary Air Insulated Switchgear applications, the panel is normally provided with a disconnector consisting typically of metal arms (usually copper arms) extending from the breaker compartment to the bus-bar compartment. In order to cross the metal separation between the compartments, it is normally foreseen the use of bushings which are normally bulky as well as costly.

Even if the functionality is achieved, the presence of the bushings with their relatively large dimension requires appropriate design and dimensioning of the compartments and consequently of the panel, taking also into account that normally the compartments generally houses a number of further components and apparatuses, such as current transformers, voltage transformers and similar equipment.

This is somehow in contrast with the need of keeping width and floor occupancy of the panel at a minimum level so as to reduce the overall dimensions of the switchgear inside the installation room.

BRIEF SUMMARY OF THE INVENTION

It should also be noted that usually the disconnector in itself is not very compact and simple, in terms of mechanism, thereby adding further complexity to the panel.

It is therefore an object of the present invention to provide a disconnector in which the above-mentioned drawbacks are avoided or at least reduced.

More in particular, it is an object of the present invention to provide a three-position disconnector for medium voltage applications of reduced complexity.

As a further object, the present invention is aimed at providing a three-position disconnector for medium voltage applications having a reduced number of mechanical parts.

A further object of the present invention is to provide a three-position disconnector for medium voltage applications of compact structure and dimensions.

Still a further object of the present invention is to provide a three-position disconnector that makes it possible to avoid, or at least reduce, the number of bushings needed for connection to a circuit breaker unit in a panel.

Another object of the present invention is to provide a three-position disconnector which allows to minimize the occupied space, both in terms of width and occupied area, of a medium voltage panel in which it is installed.

Still another object of the present invention is to provide a three-position disconnector for medium voltage application, as well as a medium voltage panel, with reduced manufacturing and installation costs.

Thus, the present invention relates to a three-positions disconnector which comprises, for each phase:

an insulating casing which comprises a first cavity and a second cavity separated by an insulated partition wall, a through hole being present in said partition between said first and second cavity;

a first fixed contact suitable for ground connection;

the first cavity housing:

a second fixed contact electrically connected to a corresponding branch conductor of a bus-bar system;

at least a portion of a movable contact pivotally mounted on a support positioned in said first cavity, said movable contact being electrically connected to a first electrical terminal;

the second cavity housing said first electrical terminal

The disconnector according to the invention also comprises an operating mechanism and a kinematical chain linking said movable contact with said operating mechanism, said movable contact being movable between a first position in which it is coupled to said second fixed contact, a second position in which it is isolated from both said first and second fixed contacts, and a third position in which it coupled to said first fixed contact.

In this way, it is possible to overcome some of the disadvantages and drawbacks of the disconnectors of the known art. The use of an insulating casing for each phase, having the aforesaid characteristics and housing the components specified above, allows to achieve mechanical support for some of the components of the disconnector as well as electrical insulation. Thus, mechanical stability and dielectric withstand are achieved without resorting to the need of having bushings. Also, the number of components and operating parts is reduced, with a consequent reduction of manufacturing, installation and maintenance costs.

In addition, the panel into which the three-positions disconnector of the invention is installed, has reduced footprints thereby being effective, not only in terms of performances, but also in terms of space saving.

BRIEF DESCRIPTION OF THE DRAWINGS

Further characteristics and advantages of the invention will emerge from the description of preferred, but not exclusive embodiments of the three-positions disconnector and medium voltage panel according to the invention, non-limiting examples of which are provided in the attached drawings, wherein.

DETAILED DESCRIPTION OF THE INVENTION

Figure 1:
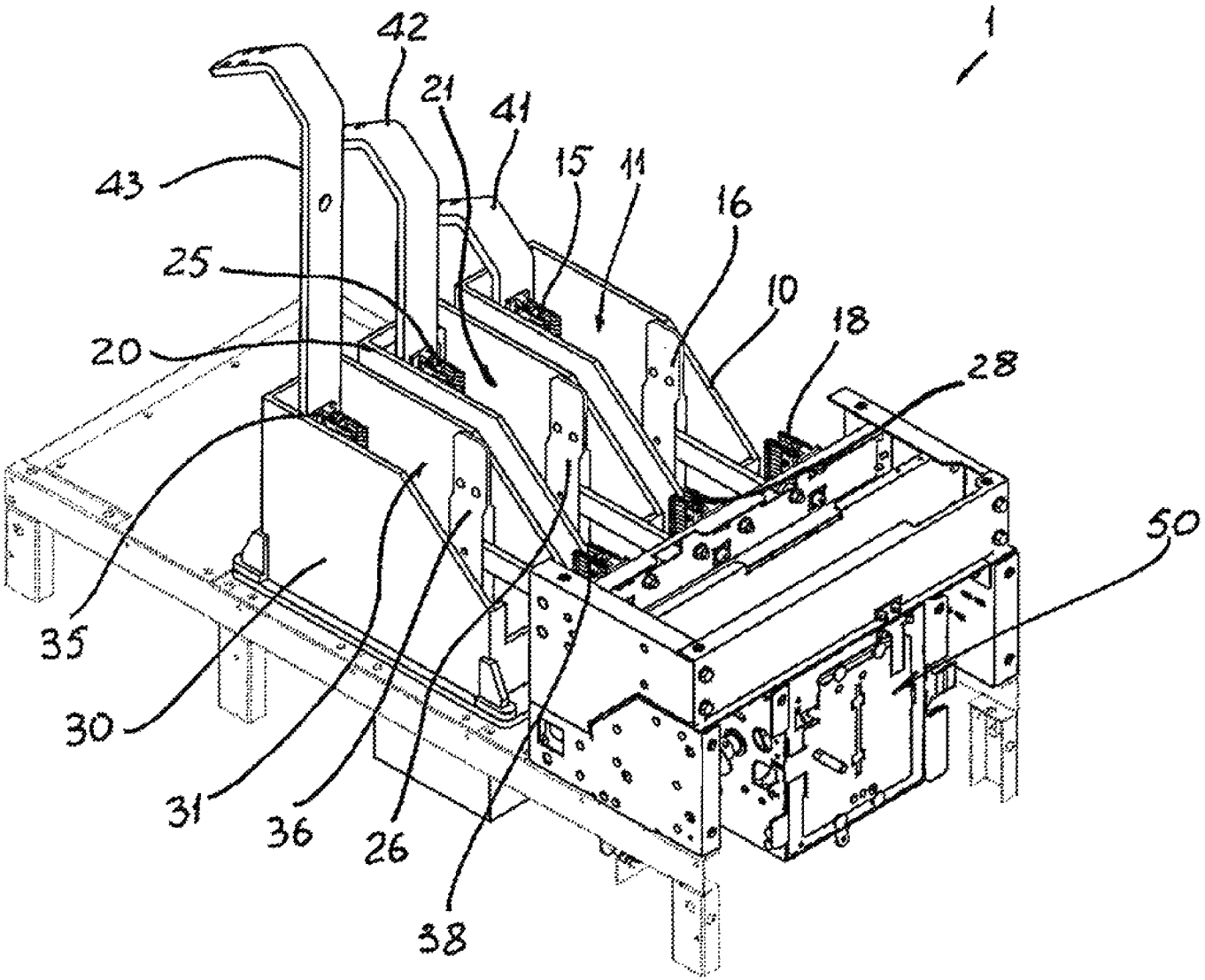
FIG. 1 is a perspective view of a first embodiment of a three-positions disconnector according to the invention.

With reference to FIG. 1, which shows a disconnector for a three-phase system, the three-positions disconnector according to the invention, designated in its entirety by the reference numeral 1, comprises for each of the three phases an insulating casing 10, 20, 30. Each casing 10, 20, 30 comprises a first cavity (respectively 11, 21, 31), and a second cavity 12, not visible in FIG. 1, but visible in FIGS. 4-8.

Figure 4:
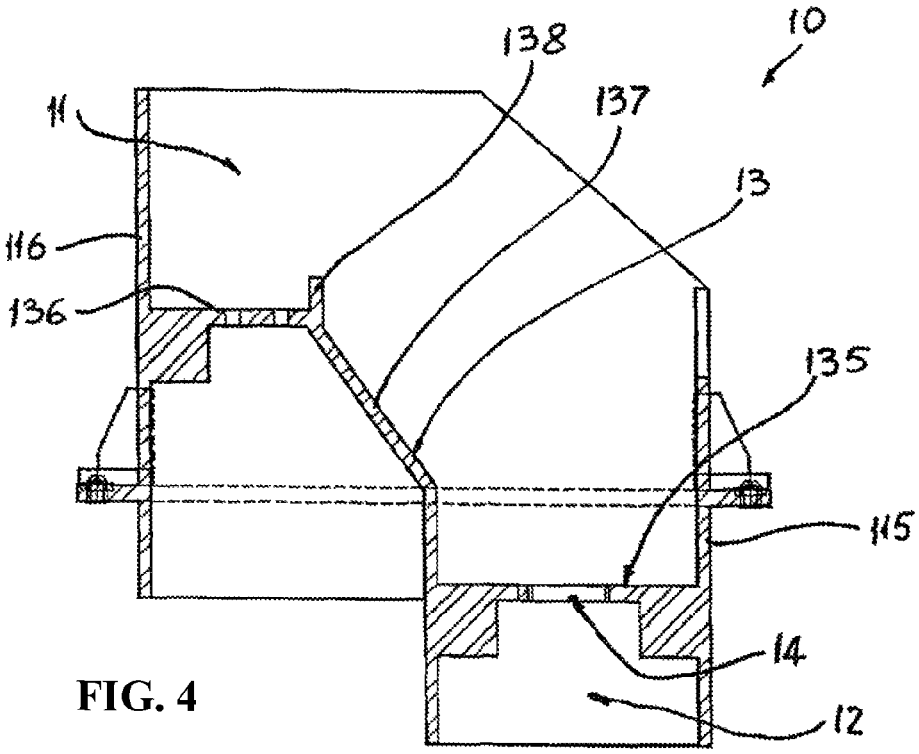
FIG. 4 is a section view of a possible embodiment of an insulating casing used in a three-positions disconnector according to the invention.
Figure 5:
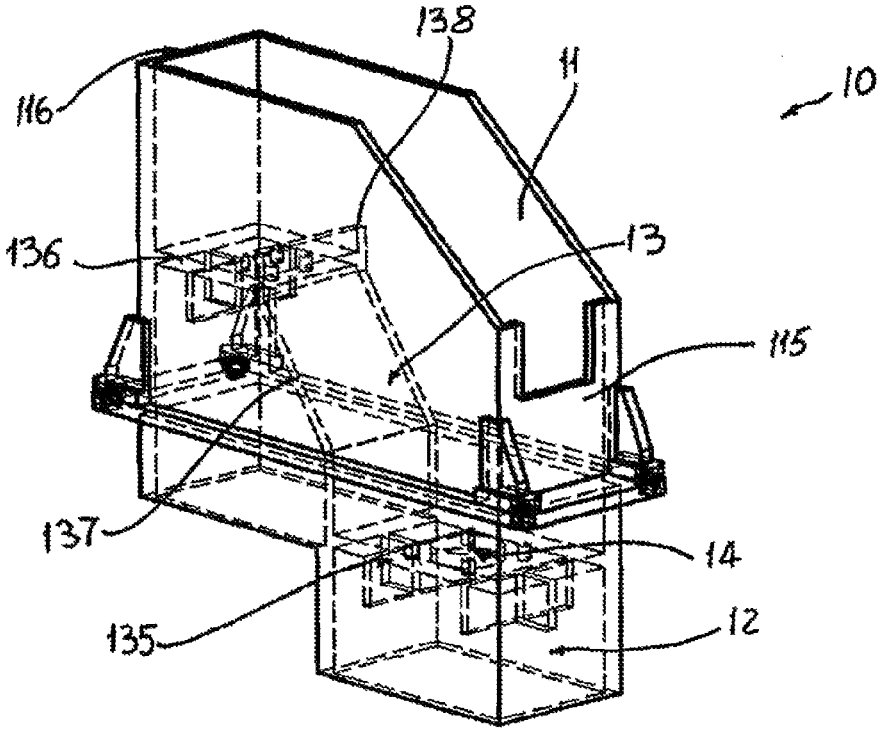
FIG. 5 is a perspective view of the casing of FIG. 4.

With reference to FIGS. 4 and 5, the first and second cavity 11,12 are separated by an insulated partition wall 13 that extends throughout the body of the casing 10. The first 11 and second 12 cavity are communicating via a through hole 14 present in said partition wall 13 between the first and second cavity 11, 12.

Figure 2:
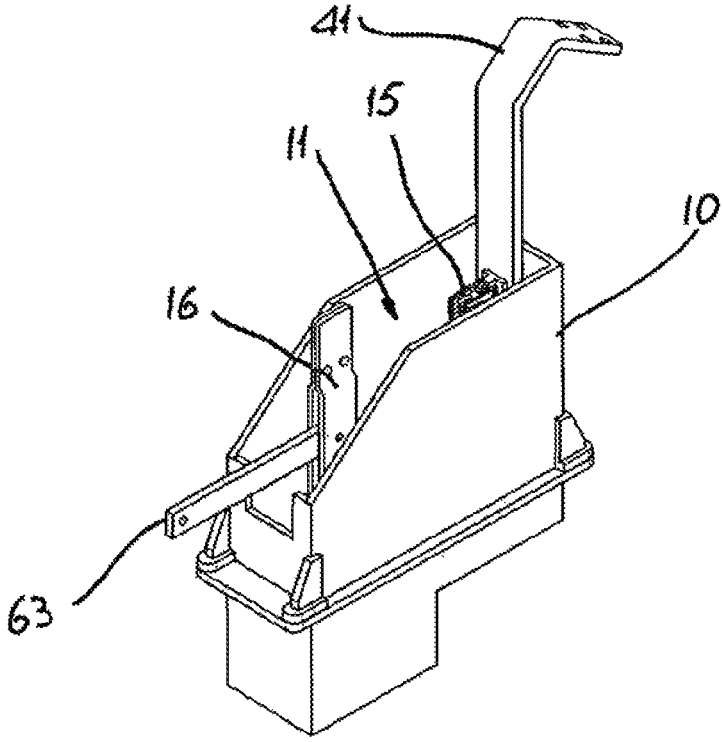
FIG. 2 is a perspective view of a detail of a three-positions disconnector according to the invention, showing an insulating casing with some components positioned therein.
Figure 3:
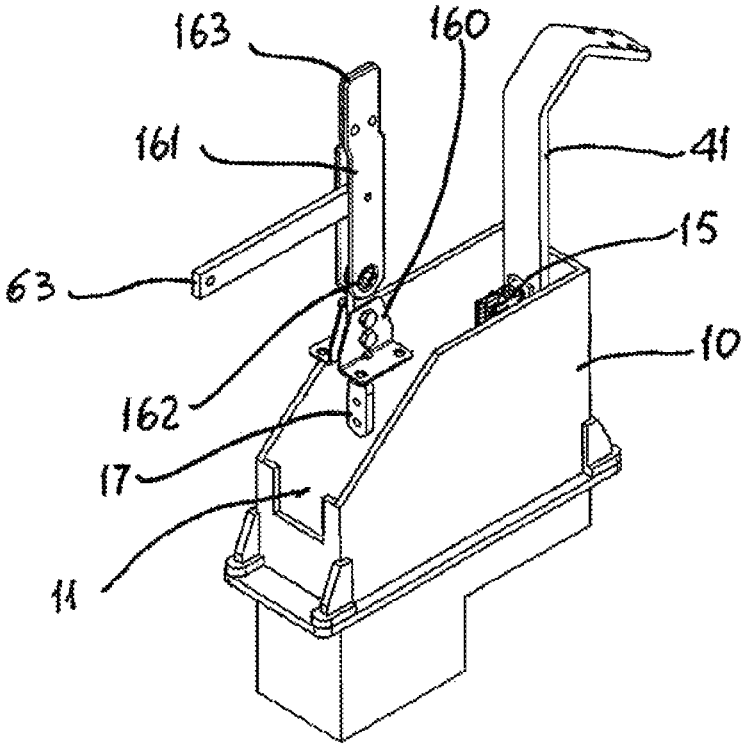
FIG. 3 is a partially exploded view of the casing and components of FIG. 2.

As Shown if FIG. 1-3, the first cavity 11, 21, 31 houses, for each phase, a second fixed contact 15, 25, 35 which is electrically connected to a corresponding branch conductor 41, 42, 43 of a bus-bar system. The first cavity also houses, for each phase, at least a portion of a movable contact 16, 26, 36 which is pivotally mounted on a support 160 positioned in said first cavity 11, 21, 31.

The movable contact 16, 26, 36 is electrically connected to a first electrical terminal 17 which is positioned in the second cavity 12 of the insulating casing.

A first fixed contact 18, 28, 38 is appropriately positioned in the nearby of the casing 10, 20, 30, so as to allow the earthing operation as better explained hereinafter.

The disconnector 1 also comprises an operating mechanism 50 and a kinematical chain 60 that connects the movable contact 16, 26, 36 with the operating mechanism 50. The movable contact is then movable between a first position in which it is coupled to the second fixed contact 15, 25, 35, a second position in which it is isolated from both the second 15, 25, and first 18, 28, 38 fixed contacts, and a third position in which it coupled to said first fixed contact 18, 28, 38.

Figure 6:
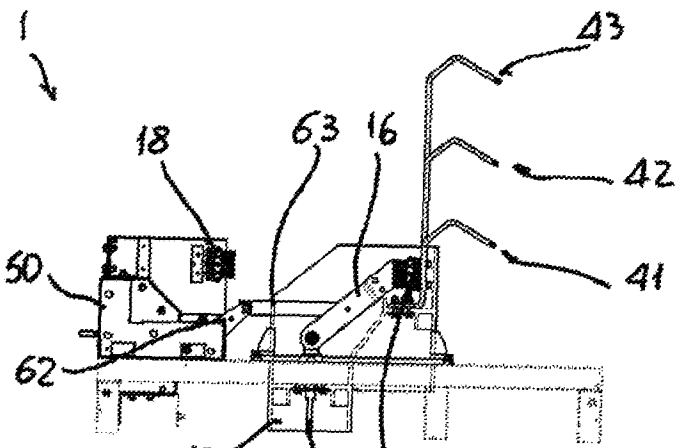
FIG. 6 is a section view of a three-positions disconnector according to the invention, showed in the service (ON) position.

With reference to FIG. 6, in practice, when the three-positions disconnector 1 of the invention is installed in a panel, the first position of the movable contact 16. in which it is coupled with the second fixed contact 15, corresponds to an operating situation of service (ON) of the disconnector 1, i.e. it is connected to the bus-bar system via the corresponding branch conductor 41. The second position, in which the movable contact 16 is separated from both first and second fixed contacts 18 and 15, corresponds to the situation of FIG. 7, thereby realizing the isolated (OFF) operating situation of the disconnector 1. Finally, in the third position, represented in FIG. 8, the movable contact 16 is connected to the first fixed contact 18, in turn appropriately connected to ground, thereby realizing the earthing (EARTH) operating situation of the disconnector. It is clear from the above that the three-positions disconnector 1 of the invention is therefore capable of realizing the three operating situations ON/OFF/EARTH in a very simple manner.

In details, the insulating casing 10, 20, 30 is preferably made as single-block casing of insulating polymeric material, thereby realizing a body that has both mechanical support and dielectric functions.

With reference to FIG. 1-3, the movable contact 16, 26, 36 preferably comprises a bar-shaped element 161 having a first end 162 which is pivotally connected to the support 160 so that a second end 163 of the movable contact moves along an arc; the first 18, 28, 38 and second 15, 25, 35 fixed contacts are suitable positioned in two points of said arc so as to make it possible their coupling/uncoupling with the movable contact 16, 26, 36.

As already said, at least a portion of the movable contact 16, 26, 36 is positioned in the first cavity 11, 21, 31 of the insulating casing 10, 20, 30, whereas the first electrical terminal 17 (electrically connected to the movable contact) is positioned in the second cavity 12 thereof. In order to keep the electrical connection between the movable contact and the first electrical terminal as short as possible, the support 160 of the movable contact 16, 26, 36 is preferably positioned in said first cavity 11, 21, 31, on the partition wall 13 at the bottom of said first cavity, in correspondence of said through hole 14. According to a preferred embodiment, shown in FIG. 3, the support 160 comprises fixing means and a connection bar, a first end of said connection bar constituting the first electrical terminal 17, the second end of said connection bar being the pivot point of the second end 162 of the bar-shaped element 161. The fixing means are fixed to said connection bar and to the partition wall 13 in correspondence of the through hole 14, with the connection bar passing through said hole 14 and having its first end (and the corresponding first electrical terminal 17) positioned in the second cavity 12 of the casing 10, while the first end thereof (with the pivot point for the movable contact 16) is positioned in the first cavity 11 of said casing 10.

Figure 7:
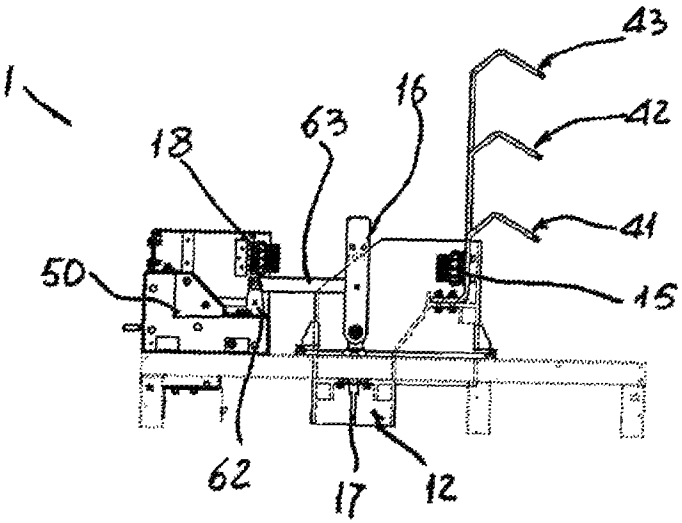
FIG. 7 is a section view of a three-positions disconnector according to the invention, showed in the isolated (OFF) position.
Figure 8:
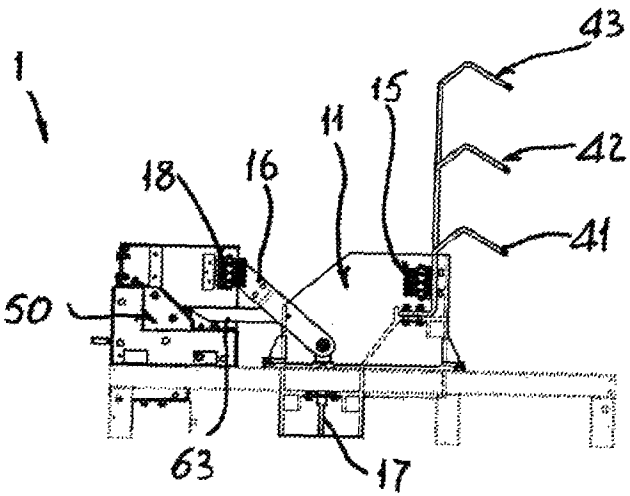
FIG. 8 is a section view of a three-positions disconnector according to the invention, showed in the earthing (EARTH) position.

Preferably, the support 160 of the movable contact 16, 26, 36 and the second contact 15, 25, 35 are positioned in said first cavity 11, 21, 31 at a different level with respect to a lateral view of said insulating casing 10, 20, 30. As shown in FIGS. 4 and 5, the partition wall 13 preferably has a first 135 and a second 136 portion, substantially parallel to each other and positioned inside the casing 10 at two different levels (with respect to a lateral view of the casing) in correspondence of two opposite walls 115, 116 of said casing 10. The two portions 135 and 136 are connected by a properly shaped third portion 137, so as to realize a partition wall 13 inside said casing 10 and divide it into at least two cavities 11 and 12. In the embodiment of FIGS. 4 and 5, the third portion 137 preferably include a first segment perpendicular to the first portion 135 and a second segment conveniently inclined. With reference also to FIGS. 6-8, the through hole 14 is positioned in said first portion 135, the support 160 being fixed to the first portion 135 adjacent to said hole 14. At least a portion of the branch connector 41, 42, 43 is positioned in the first cavity 11 and is fixed to the bottom thereof in correspondence of the second portion 136 of the partition wall 13. The second portion 136 includes a protrusion 138 running on the entire width of the cavity 11. The protrusion 138 has a double function of assisting the mechanical support and the dielectrical shield of the branch connection 41, 42, 43.

In this way, the three-positions disconnector of the invention can have a very compact structure and maintain at the same time very good mechanical properties and dielectrical withstanding. Thanks to the insulating casing 10, 20, 30 it is in fact possible to realize a system in which the insulation between the phases is not only air, as in conventional disconnectors for Air Insulated Switchgear, but a hybrid system of air+insulating solid+air+insulating solid+air, thereby contributing to the compactness of the whole system.

In addition, also the maneuvering of the disconnector can be realized in a very simple and effective way. To this end, the kinematical chain 60 preferably comprises a rotary shaft 61 which is operatively connected to the operating mechanism 50. Then, for each phase, the kinematical chain 60 comprises a first crank 62 which is rigidly coupled to said shaft 61 and a connecting rod 63 which connects the crank 62 to said movable contact 16, 26, 36.

Preferably, the connecting rod 63 is connected to the bar-shaped element 161 of the movable contact 16 at a point between said first 162 and second 163 end thereof. The functioning of the kinematical chain 60 is clearly shown in FIGS. 6-8 which represent three different operating situation of the disconnector. The operating mechanism 50 can, for instance, includes a rotary shaft and a connecting rod coupling the rotary shaft of the mechanism with the crank 62 of the kinematical chain 60. Preferably, the operating mechanism 50 comprises a handle bar 51 for manual actuation thereof.

The three-positions disconnector according to the invention finds convenient application in Medium Voltage panels. Accordingly, Medium Voltage panels including a three-positions disconnector as disclosed herein constitute a further aspect of the present invention.

Figure 9:
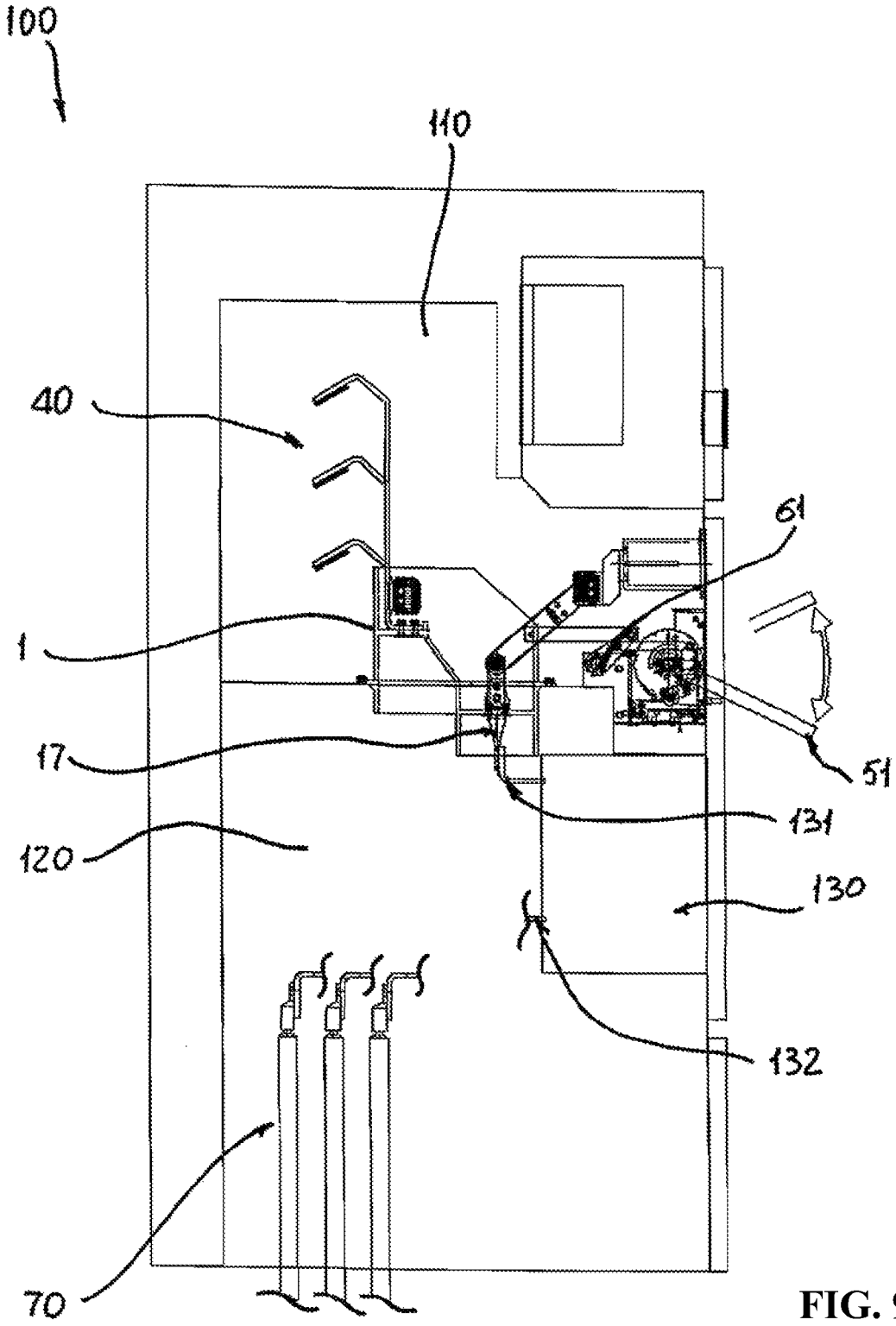
FIG. 9 is a section view of a first possible embodiment of a Medium Voltage panel, in which a three-positions disconnector according to the invention is used.

With reference to FIG. 9, a possible embodiment of a Medium Voltage panel 100 of the invention comprises a first compartment 110 housing a bus-bar system 40 and a second compartment 120 housing a cable system 70. A metal segregation between the compartments is normally foreseen. A three-position disconnector as disclosed hereinabove is placed in said panel 100 at the interface between the bus-bar compartment 110 and the cable compartment 120 so that the first cavity 11 of the casing 10 faces toward the bus-bar compartment 110, while the second cavity 12 of the casing 10 faces toward the cable compartment 120.

A circuit breaker unit 130 is appropriately positioned inside the casing 100 and has, for each phase, a second electrical terminal 131 connected to the first electrical terminal 17 of said three-positions disconnector 1; the circuit breaker unit 130 has also a third electrical terminal 132 which is connected to a corresponding cable of said cable system 70.

As clearly shown in FIG. 9, the resulting lay-out of the panel is extremely compact. The circuit breaker unit 100 is directly connected to the three-positions disconnector via the first and second terminal 17, 131 without the need of having any bushing interposed between them. Indeed, for the purposes of the present invention the term "directly connected" means that the circuit breaker unit and the disconnector are connected to each other without interposing any bushing.

Preferably, the Medium Voltage panel 100 according to the present invention has a fixed circuit breaker configuration. In this way, it is possible to reduce the overall dimensions of than panel, particularly its footprints, with a consequent saving of occupied area.

Also, the Medium Voltage panel 100 according to the present invention can normally comprise mechanical interlocking means between said three-positions disconnector 1 and said circuit breaker unit 130. Further equipment, such as current transformers, voltage transformers, fuses and similar apparatuses may also be present according to the specific needs of use.

It is clear from the above that the three-positions disconnector and the Medium Voltage of the invention have a number of advantages with respect to similar disconnector and panels of known type.

In particular, the three-positions disconnector of the invention is very compact, easy to realize and easy to maintain. This allows to reduce the number of components, thereby reducing the manufacturing, installation and maintenance costs. Its simplified construction and operating concepts allows further saving of costs, particularly in terms of copper connections normally needed in conventional panels.

Even more important, and thanks to the mechanical and dielectrical properties imparted by the insulating casing, it is possible to avoid the use of bushing for connection to the circuit breaker unit in the panel. The resulting overall structure of the panel can be significantly more compact with respect the panel of known type, with saving of space as well as of cost of the bushings.

The three-positions disconnector and the panel thus conceived may undergo numerous modifications and come in several variants, all coming within the scope of the inventive concept. Moreover, all the component parts described herein may be substituted by other, technically equivalent elements. In practice, the component materials and dimensions of the device may be of any nature, according to need and the state of the art.

The invention claimed is:

1. A three-positions disconnector for a three-phase system, characterized in that it comprises, for each phase:

an insulating casing which comprises a first cavity and a second cavity separated by an insulated partition wall, a through hole being present in said partition wall between said first and second cavity;

a first fixed contact suitable for ground connection;

the first cavity housing:

a second fixed contact electrically connected to a corresponding branch conductor of a bus-bar system;

at least a portion of a movable contact pivotally mounted on a support positioned in said first cavity, said support extending through said hole to form a first electrical terminal, said movable contact being electrically connected to a first electrical terminal;

the second cavity housing said first electrical terminal;

the disconnector also comprising an operating mechanism and a kinematical chain linking said movable contact with said operating mechanism, said movable contact being movable between a first position in which it is coupled to said second fixed contact, a second position in which it is isolated from both said second and first fixed contacts, and a third position in which it coupled to said first fixed contact.

2. The three-positions disconnector of claim 1, characterized in that said insulating casing is a single-block casing made of polymeric material.

3. The three-positions disconnector of claim 1, characterized in that said movable contact comprises a bar-shaped element having a first end pivotally connected to said support and a second end that is movable along an arc, said first and second fixed contacts being positioned in two points of said arc.

4. The three-positions disconnector according to claim 3, characterized in that said support of the movable contact is positioned in said first cavity on said partition wall in correspondence of said through hole.

5. The three-positions disconnector according to claim 4, characterized in that said support of the movable contact and said second contact are positioned in said first cavity at a different level with respect to a lateral view of said insulating casing.

6. The three-positions disconnector according to claim 1, characterized in that said kinematical chain comprises a rotary shaft operatively connected to said operating mechanism and, for each phase, a first crank rigidly coupled to said shaft and a connecting rod which connects said crank to said movable contact.

7. The three-positions disconnector according to claim 5, characterized in that said connecting rod is connected to said bar-shaped element at a point between said first and second end thereof.

8. The three-positions disconnector according to claim 1, characterized in that said operating mechanism comprises a handle bar.

9. A Medium Voltage panel, characterized in that said it comprises a three-positions disconnector according to claim 1.

10. A three-positions disconnector, characterized in that it comprises, for each phase;

an insulating casing which comprises a first cavity and a second cavity separated by an insulated partition wall, a through hole being present in said partition wall between said first and second cavity;

a first fixed contact suitable for ground connection:

the first cavity housing:

a second fixed contact electrically connected to a corresponding branch conductor of a bus-bar system;

at least a portion of a movable contact pivotally mounted on a support positioned in said first cavity, said movable contact being electrically connected to a first electrical terminal;

the second cavity housing said first electrical terminal;

the disconnector also comprising an operating mechanism and a kinematical chain linking said movable contact with said operating mechanism, said movable contact being movable between a first position in which it is coupled to said second fixed contact, a second position in which it is isolated from both said second and first fixed contacts, and a third position in which it coupled to said first fixed contact;

a first compartment housing a bus-bar system and a second compartment housing a cable system; said three-positions disconnector being positioned at the interface between said first and second compartments, with said first cavity of said insulating casing facing towards said first compartment and said second cavity of said insulating casing facing towards said second compartment; the panel also comprising a circuit breaker unit having, for each phase, a second electrical terminal connected to said first electrical terminal of said three-positions disconnector, and a third electrical terminal connected to a corresponding cable of said cable system.

11. The Medium Voltage panel according to claim 10, characterized in that said circuit breaker unit is directly connected to said three-positions disconnector.

12. The Medium Voltage panel according to claim 10, characterized in that it has a fixed circuit breaker configuration.

13. The three-positions disconnector of claim 2, characterized in that said movable contact comprises a bar-shaped element having a first end pivotally connected to said support and a second end that is movable along an arc, said first and second fixed contacts being positioned in two points of said arc.

14. The three-positions disconnector according to claim 13, characterized in that said support of the movable contact is positioned in said first cavity on said partition wall in correspondence of said through hole.

15. The three-positions disconnector according to claim 14, characterized in that said support of the movable contact and said second contact are positioned in said first cavity at a different level with respect to a lateral view of said insulating casing.

16. The three-positions disconnector according to claim 15, characterized in that said connecting rod is connected to said bar-shaped element at a point between said first and second end thereof.

* * * * *